US006313746B1

(12) United States Patent
Emmerich et al.

(10) Patent No.: US 6,313,746 B1
(45) Date of Patent: Nov. 6, 2001

(54) MAGNET MARKER STRIP AND A METHOD OF PRODUCING A MAGNETIC MARKER STRIP

(75) Inventors: Kurt Emmerich, Alzenau; Giselher Herzer, Bruchköbel, both of (DE)

(73) Assignee: Vacuumschelmze GmbH, Hanau (DE)

( * ) Notice: Subject to any disclaimer, the term of this patent is extended or adjusted under 35 U.S.C. 154(b) by 0 days.

(21) Appl. No.: 09/556,410

(22) Filed: Apr. 24, 2000

(30) Foreign Application Priority Data

Apr. 23, 1999 (DE) ..... 199 18 589

(51) Int. Cl.[7] ..... G08B 13/14

(52) U.S. Cl. ..... 340/572.2; 340/572.1; 340/572.3; 340/572.6; 235/493; 156/269; 156/302

(58) Field of Search ..... 340/572.2, 572.1, 340/572.3, 574.4, 572.5, 572.6, 572.7, 572.8, 572.9; 235/493; 156/269, 302

(56) References Cited

U.S. PATENT DOCUMENTS

| | | | | |
|---|---|---|---|---|
| 3,586,593 | * | 6/1971 | Dahl, Jr. | 340/572.1 |
| 3,746,606 | * | 7/1973 | Chao | 340/572.1 |
| 3,820,104 | * | 6/1974 | Fearon | 340/572.1 |
| 3,870,867 | * | 3/1975 | Hamisch, Sr. | 235/439 |
| 4,222,517 | * | 9/1980 | Richardson | 235/493 |
| 4,298,862 | * | 11/1981 | Gregor et al. | 340/572.1 |
| 4,484,184 | * | 11/1984 | Gregor et al. | 340/572.1 |
| 4,510,490 | * | 4/1985 | Anderson, III et al. | 340/572.1 |
| 4,553,136 | * | 11/1985 | Anderson, III et al. | 340/572.1 |
| 5,015,993 | * | 5/1991 | Strom-Olsen et al. | 340/551 |
| 5,565,847 | * | 10/1996 | Gambino et al. | 340/572.1 |
| 5,580,664 | * | 12/1996 | Tsai | 340/572.1 |
| 5,757,272 | * | 5/1998 | Herzer et al. | 340/572.1 |

FOREIGN PATENT DOCUMENTS

| | | |
|---|---|---|
| 3026482A1 | 2/1982 | (DE) . |
| 0017801B1 | 5/1983 | (EP) . |
| C121649B1 | 10/1984 | (EP) . |
| 0291726B1 | 11/1988 | (EP) . |

* cited by examiner

*Primary Examiner*—Nina Tong
(74) *Attorney, Agent, or Firm*—Herbert L. Lerner; Laurence A. Greenberg; Werner H. Stemer

(57) ABSTRACT

The magnetic marker strip is formed of a signal strip made from ferromagnetic material with a low coercive force onto which there is applied ferromagnetic material whose coercive force is distinctly higher than that of the material of the signal strip. The signal strip is relatively long as compared with its width, and emits harmonic-containing signals in a first, unmagnetized state as a consequence of the magnetic field in the interrogation region and emits no harmonic-containing signal in a second state in this magnetic field. The ferromagnetic material with the larger coercive force is arranged in the form of a plurality of control elements at a spacing from one another on the signal strip, the width of the control elements being essentially equal to the width of the signal strip, and the control elements switching the signal strip into the first state when they are in a first, unmagnetized state, and switching the signal strip into the second state when they are in a second, magnetized state. The signal strip is cut to length from a tape made from an amorphous, ductile alloy that is virtually free from magnetostriction transversely to the longitudinal axis of the tape, and the tape has a flat B-H loop whose axis is parallel to the longitudinal axis of the band.

14 Claims, 4 Drawing Sheets

MAGNET MARKER STRIP AND A METHOD OF PRODUCING A MAGNETIC MARKER STRIP

BACKGROUND OF THE INVENTION

FIELD OF THE INVENTION

The invention relates to a magnetic marker strip that generates a signal inside an interrogation zone in which there is present a periodically varying magnetic field with a predetermined fundamental frequency. The signal generated by the marker strip is picked up by a scanning device and, if a higher-order harmonic of the fundamental frequency is detected as being present in the signal, a display is generated.

The magnetic marker comprises a signal strip made from ferromagnetic material with a low coercive field strength onto which there is applied ferromagnetic material whose coercive field strength is distinctly higher than that of the material of the signal strip. Such magnetic marker strips are disclosed, for example, in U.S. Pat. No. 4,222,517 (see German published application DE 30 26 482 A1) and in U.S. Pat. No. 4,553,136 (see European patent EP 0 121 649 B1).

The German publication DE 30 26 482 A1and its progeny, U.S. Pat. No. 4,222,517, are herewith expressly incorporated by reference. There is disclosed a marker strip of the type mentioned above with a signal strip that is relatively long as compared with its width and that emits harmonic-containing signals in a first, unmagnetized state as a consequence of the magnetic field in the interrogation region and emits no harmonic-containing signal in a second state in this magnetic field. The ferromagnetic material having the higher coercive field strength is arranged there in the form of a plurality of deactivating elements at a spacing from one another on the signal strip. The width of the deactivating elements is essentially equal to the width of the signal strip. The deactivating elements switch the signal strip into the first state when they are in a first, unmagnetized state, and they switch the signal strip into the second state when they are in a second, magnetized state.

The signal strips described there are typically produced from crystalline, highly permeable nickel-iron alloys with a high nickel content.

The alloys described in the prior art disclosure are disadvantageous in that they are very sensitive to mechanical deformations such as bending or twisting with reference to their magnetic properties. The sensitivity goes so far that a single instance of bending the signal strip to and fro is enough to cause a complete breakdown of its functional effectiveness.

The use of the magnetic marker strips described in U.S. Pat. No. 4,222,517 and German publication DE 30 26 482 A1is therefore limited to application in providing security for books as goods in libraries. In that case, sensitivity to mechanical deformations play a greatly subordinate role, since mechanical deformation of the signal strips is prevented to the greatest possible extent by the stiffness of the books.

Amorphous, ferromagnetic alloys are proposed in European patent EP 0 017 801 B1 (see U.S. Pat. Nos. 4,298,862, reissued as RE32,427, and 4,484,184, reissued as RE32,428) and in European Patent EP 0 121 649 B1 (see U.S. Pat. No. 4,553,136) as substantially more suitable materials for the low-coercive signal strips in magnetic marker strips. After being bent to and fro, amorphous, ferromagnetic alloys do not change their magnetic properties to the extent of crystalline, ferromagnetic alloys. As a result, the mechanical stress during production of the magnetic marker strips or during their fastening on the item to be secured does not cause an impairment of their functional effectiveness.

U.S. Pat. No. 4,553,136 (EP 0 121 649 B1) proposes for the use of amorphous, ferromagnetic alloys as signal strips for magnetic marker strips selected alloys which have a saturation magnetostriction $\lambda_s$ which is as low as possible and renders the signal independent of internal and external stress states of the signal strip.

It is set forth as a particular advantage in U.S. Pat. No. 4,552,136 and European Patent EP 0 121 649 B1 that the selected alloys taught there already have a B-H loop, which is rectangular, in the manufactured state, that is to say therefore directly after being cast using rapid solidification technology. The shape of the magnetic hysteresis (B-H loop) of the ferromagnetic material is of very great importance for generating a high harmonic. If a metal object is magnetized by introducing a magnetic field into it, a certain magnetization remains after switching off the magnetic field. The remanence of the magnetization of ferromagnetic materials with respect to the field strength is a measurable variable which can be detected using a curvilinear representation which is generally denoted as a B-H loop. The alloys taught there already have the required rectangular B-H loop in the manufactured state without the need for heat treatment. According to the disclosure in U.S. Pat. No. 4,552,136 and European Patent EP 0 121 649 B1, heat treatment is even disadvantageous, since it tends to result in embrittlement of the amorphous, ferromagnetic alloy. The use of heat treatment is therefore described in U.S. Pat. No. 4,552,136 and European Patent EP 0 121 649 B1 only in conjunction with the production of a partially crystalline or crystalline state for better processability.

It is increasingly the case that goods are no longer being provided by the retail trade with magnetic marker strips, but are already being processed with a magnetic marker strip at the manufacturing stage. This is referred to as source tagging. The reliability to deactivate the magnetic marker strips and, at the same time, economic fabrication are rendered urgent requirements by this development, since now very many goods with magnetic marker strips come about independently of whether an individual retail trader is using a corresponding goods security system or not.

Magnetic marker strips currently available use signal strips made from amorphous, ferromagnetic alloys in typical widths of between 0.7 mm and 2.5 mm in lengths of between 30 mm and 90 mm. For the purpose of deactivation, there are applied to these signal strips a ferromagnetic material whose coercive field strength is distinctly higher than that of the material of the signal strip. In this case, these more highly coercive alloys have coercive field strengths of between 15 A/cm and 100 A/cm. As a rule, these more highly coercive strips are between 3 and 15 mm long and are designed to be 2 to 4 mm wider than the signal strips so that they can be fastened.

These deactivation elements are cut to length individually from a feed roll during the production process. As a rule, they are then fastened via adhesive films which also fix the continuous signal strips of the magnetic marker strip.

By comparison with the method of production described in U.S. Pat. No. 4,222,517 and German patent application DE 30 26 482 A1, and illustrated in FIG. 1 thereof, these methods of production have the disadvantage that the materials used run in each case as narrow tapes into the production process, and the deactivation elements must be cut to length in a process step which has to run at a very high cycling speed for economic reasons.

In the method described in U.S. Pat. No. 4,222,517 and German patent application DE 30 26 482 A1, the deactivation elements are fixed as continuous individual, narrow strips on a wide tape of the signal strip, and the finished magnetic marker strip is finally cut to length. The advantage of this method resides in the economizing use of wide tapes for the signal strip, accompanied by the use of a single process of cutting to length per magnetic marker strip instead of the multiple process steps including fastening in the case of the conventional production, described above, of magnetic marker strips with signal strips of amorphous, ferromagnetic alloys.

An attempt was therefore made also to implement the cost-effective production method, taught in U.S. Pat. No. 4,222,517 and German patent application DE 30 26 482 A1, for magnetic marker strips with signal strips made from crystalline nickel-iron alloys with the amorphous, ferromagnetic alloys taught in U.S. Pat. No. 4,552,136 and European Patent EP 0 121 649 B1. Surprisingly, however, it has emerged that the production method taught there cannot be carried out using the amorphous, ferromagnetic selected alloys taught in U.S. Pat. No. 4,552,136 and European Patent EP 0 121 649 B1.

In a first experiment, a wide tape made from an amorphous, ferromagnetic alloy of the composition of $Co_{58}Fe_{5.5}Ni_{13}Si_{14.5}B_9$ was produced by means of rapid solidification technology with a tape width of 54 mm and a mean thickness of 25 $\mu$m. The saturation magnetostriction $\lambda_s$ was −0.5 ppm. The saturation induction $B_s$ of the cast tape was 0.7 Tesla. The tape produced also had a rectangular B-H loop with a remanence ratio (synonymous with the "rectangularity") of approximately 85%.

121 649 B1, it was, surprisingly, not possible to detect in the induced voltage a harmonic signal, that is to say a harmonic component, which lay above the usual noise level.

In a second experiment, a cast wide tape having the same alloy composition as above was subjected to heat treatment. For this purpose, an approximately 2 kg heavy tape coil was heat- treated for approximately two hours at a temperature of 230° C. During the heat treatment, a constant magnetic field was additionally applied in the circumferential direction of the tape coil, that is to say parallel, therefore, to the casting direction of the wide tape ("longitudinal field treatment"). The strength of the constant magnetic field was set such that the wide tape was ferromagnetically saturated in the direction of the applied constant magnetic field. The field strength was 10 A/cm in this case. It was possible by means of this treatment to improve the "rectangularity" of the B-H loop of the amorphous, ferromagnetic alloy to virtually 100%, with the result that all the criteria required by U.S. Pat. No. 4,552,136 and European Patent EP 0 121 649 B1 were optimally fulfilled.

A signal strip was, in turn, cut to length from the wide tape, heat-treated in such a way, in a fashion transverse to the longitudinal axis of the wide tape, and its harmonics were measured as in the first experiment. Although the amorphous, ferromagnetic alloy now exhibited a virtually perfectly rectangular B-H loop, no harmonic signal of any kind could be detected. The spectral analysis indicated no harmonic components which lay above the usual noise level. Further experiments were set up for a whole range of various alloy compositions. The results are summarized below in Table 1.

Table 1: Exemplary Embodiments According to the Invention

| Composition (at %) | $J_s$ (T) | $\lvert\lambda_s\rvert$ (ppm) | In produced state | Harmonic response: After longitudinal field treatment | Harmonic response: After transverse field treatment |
|---|---|---|---|---|---|
| $Co_{58}Fe_{5.5}Ni_{13}Si_{14.5}B_9$ | 0.70 | <1 | NO | NO | YES |
| $Co_{52}Fe_{5.5}Ni_{18}Si_{15.5}B_9$ | 0.59 | <1 | NO | NO | YES |
| $Co_{43.3}Fe_{6.7}Ni_{28}Si_{13}B_9$ | 0.58 | <1 | NO | NO | YES |
| $Co_{67.3}Fe_{3.7}Mo_{1.5}Si_{16.5}B_{11}$ | 0.55 | <1 | Very slight | NO | YES |
| $Co_{71.8}Fe_1Mn_4Mo_1Si_{13.2}B_9$ | 0.82 | <1 | NO | NO | YES |
| $Co_{58.5}Fe_{5.5}Mn_1Ni_{15}Si_4B_{16.5}$ | 0.90 | <1 | NO | NO | YES |
| $Co_{74.5}Fe_{15}Mn_4Si_{11}B_9$ | 1.00 | <1 | NO | NO | YES |
| $Co_{31}Fe_{6.5}Ni_{40.5}Si_{13}B_9$ | 0.41 | <1 | Very slight | NO | YES |

A signal strip with a width of 2 mm was then cut to length from this cast wide tape transverse to the longitudinal axis of the cast wide tape and its harmonics were measured. For this purpose, the signal strip was excited using an alternating magnetic field with an amplitude of 1 A/cm and a frequency of 1 kHz. The signal strip was orientated in this case parallel to the terrestrial magnetic field, which corresponds to a constant field premagnetization of approximately 0.2 A/cm. The variation in induction caused by the alternating field was measured in an air-compensated pickup coil surrounding the center of the signal strip and having 100 turns, use being made of the voltage induced there. The induced voltage was then decomposed by means of a spectral analyzer into its constituent frequencies, that is to say the harmonic analysis was carried out.

Although the material produced exhibited all the criteria taught in U.S. Pat. No. 4,552,136 and European Patent EP 0

It was possible to confirm the finding for all alloy compositions that amorphous ferromagnetic alloy tapes such as are taught in U.S. Pat. No. 4,552,136 and European Patent EP 0 121 649 B1 cannot be processed to form magnetic marker strips using the production method taught in U.S. Pat. No. 4,222,517 and German patent application DE 30 26 482 A1.

OBJECT AND SUMMARY OF THE INVENTION

It is accordingly an object of the invention to provide amorphous, ferromagnetic alloys, which overcome the above-mentioned disadvantages of the heretofore-known devices and methods of this general type and which can be processed to form magnetic marker strips using the method taught in U.S. Pat. No. 4,222,517 and German patent application DE 30 26 482 A1.

With the foregoing and other objects in view there is provided, in accordance with the invention, a magnetic marker strip for generating a signal inside an interrogation zone in which a periodically varying magnetic field with a predetermined fundamental frequency is present. The signal generated by the marker strip can be picked up by a scanning device and, if a higher-order harmonic of the fundamental frequency is detected in the signal, for a display to be generated. The magnetic marker strip comprises:

a signal strip of a first ferromagnetic material having a low coercive field strength, the signal strip having a greater length than width, and emitting harmonic-containing signals in a first, unmagnetized state when exposed to a magnetic field in an interrogation zone and emitting substantially no harmonic-containing signal in a second state in the magnetic field;

the signal strip being cut to length from a tape transversely to a longitudinal axis of the tape, the tape consisting of an amorphous, ductile alloy virtually free from magnetostriction, and having a flat B-H loop with an axis parallel to the longitudinal axis of the tape;

a second ferromagnetic material applied on the signal strip and having a coercive field strength distinctly higher than the coercive field strength of the first ferromagnetic material of the signal strip; and the second ferromagnetic material being formed in a plurality of deactivating elements disposed at a spacing from one another on the signal strip, the deactivating elements having a width substantially equal to the width of the signal strip, and the deactivating elements switching the signal strip into the first state when the deactivating elements are in a first, unmagnetized state, and switching the signal strip into the second state when the deactivating elements are in a second, magnetized state.

In other words, the objects of the invention are satisfied with a magnetic marker strip of the type mentioned at the beginning which has a signal strip cut to length from a tape made from an amorphous, ductile alloy that is virtually free from magnetostriction. The cut is transverse to the longitudinal axis of the tape. The tape has a flat B-H loop whose axis is parallel to the longitudinal axis of the band. A flat B-H loop is understood to be a hysteresis loop with a ratio of remanence to saturation magnetization Bs of <20% or $B_r/B_s<10\%$.

To be specific, it has emerged that the amorphous, ferromagnetic alloy tapes produced according to the prior art do have a rectangular B-H loop, but only in the casting direction. However, this rectangular B-H loop present in the casting direction is not sufficient for the functional effectiveness of the magnetic marker strip produced therefrom in the case of signal strips cut to length transverse to the longitudinal axis of the wide tape. Consequently, in accordance with the basic idea of the present invention (represented in FIG. 2), the cast tape was heat-treated such that a flat B-H loop is present along the casting direction. As soon as a flat B-H loop is present in the casting direction of the tape, a rectangular B-H loop is present in the direction transverse to the casting direction and then renders possible the targeted, cost-effective further processing to form a magnetic marker strip.

In accordance with an added feature of the invention, the alloy with the following composition turned out to be particularly suitable:

$$Co_aFe_bNi_cX_dB_eSi_f$$

where X is at least one element selected from the group of elements consisting of Cr, Mo, Nb, and Ta, and a, b, c, d, e, and f, in at %, satisfy the following conditions:

| | |
|---|---|
| $25 \leqq a \leqq 80$ | $0 \leqq d \leqq 5$ |
| $2 \leqq b \leqq 10$ | $8 \leqq e \leqq 20$ |
| $0 \leqq c \leqq 45$ | $0 \leqq f \leqq 18$ |

wherein $15 \leqq (e+f) \leqq 30$ and $a+b+c+d+e+f=100$ and;

if appropriate, up to 2 at % of an existing B and Si content are replaced together by at least one element selected from the group of elements consisting of C, P, Al, and Ge;

if appropriate, up to 5 at % of an existing Fe content is replaced by Mn.

If these alloys are subjected to continuous heat treatment, typically under tensile stress or in a magnetic field transverse to the longitudinal axis of the cast amorphous, ferromagnetic tape, it is possible to set a very flat B-H loop in the casting direction. Known alloy systems are likewise virtually free of magnetostriction, have a satisfactory saturation induction and, after being heat-treated and cut to length transverse to the longitudinal axis of the cast tape, have a rectangular B-H loop which yields an excellent level of serviceability for the magnetic marker strips to be produced.

Particularly advantageous alloys are yielded for the implementation of particularly short lengths of signal strip and an excellent degree of mechanical insensitivity with the aid of the above-named amorphous, ferromagnetic alloy system, in which the following conditions hold:

$19 \leqq (e+f) \leqq 23$ and $20 \leqq c \leqq 45$; 1.

$23 \leqq (e+f) \leqq 26$ and $10 \leqq c \leqq 20$; 2.

$26 \leqq (e+f) \leqq 30$ and $c<10$. 3.

Particular preference is accorded to option 2 and option 3, since they ensure an excellent response to the heat treatments and a very good ductility.

In accordance with an added feature of the invention, the signal strip has a saturation magnetization of $B_s \leqq 0.7$ T.

In accordance with an additional feature of the invention, the alloy has a saturation magnetostriction of $|\lambda_s| \leqq 1$ ppm.

With the above and other objects in view there is also provided a method of producing the marker strip according to the above-outlined invention. The method comprises the following steps:

casting an amorphous, ferromagnetic tape with a longitudinal axis from a melt by rapid solidification; subjecting the amorphous, ferromagnetic tape to continuous heat treatment;

applying at least two comparatively narrow strips of a ferromagnetic material with a distinctly higher coercive field strength to the amorphous, ferromagnetic tape axially parallel to the longitudinal axis;

connecting the strips to the tape; and cutting the amorphous, ferromagnetic tape and the strips to length transverse to the longitudinal axis of the amorphous, ferromagnetic tape.

In accordance with another feature of the invention, the amorphous, ferromagnetic tape is subjected to continuous heat treatment under tensile strength.

In accordance with again another feature of the invention, the amorphous, ferromagnetic tape is subjected to heat treatment in a magnetic field transverse to the longitudinal axis of the amorphous, ferromagnetic tape.

In accordance with a concomitant feature of the invention, the connecting step comprises gluing the strips to the tape.

In a variation, stationary heat treatment is carried out instead of continuous heat treatment. Accordingly, the method of producing the above-outlined marker strip comprises the following steps:

casting an amorphous, ferromagnetic tape from a melt by rapid solidification;

winding the amorphous, ferromagnetic tape about a winding axis to form a tape coil; and subjecting the tape coil to heat treatment in a magnetic field parallel to the winding axis of the tape coil (i.e. transverse to the casting direction of the tape—referred to as transverse field treatment—illustrated in FIG. 3);

subsequently, applying from the heat-treated tape coil at least two relatively narrow strips of a ferromagnetic material with a distinctly higher coercive field strength to the amorphous, ferromagnetic tape axially parallel to the longitudinal axis of the tape;

connecting the strips to the tape; and cutting to length the amorphous, ferromagnetic tape and the strips connected thereto transverse to the longitudinal axis of the amorphous, ferromagnetic tape.

The rate of throughput in the case of continuous heat treatment is preferably selected such that the amorphous, ferromagnetic tape is heated up to a temperature of 280° C.$\leqq$T$\leqq$380° C. for a heat treatment time of 2s$\leqq$t$\leqq$60 s.

If the application of the magnetic field is dispensed with and the heat treatment is carried out instead under tensile stress, the application of a force of F>5N in the longitudinal direction of the tape has proved to be particularly advantageous.

If instead of continuous heat treatment stationary heat treatment is carried out on a tape coil, heat treatment times of 0.5 h$\leqq$t$\leqq$20 h to a temperature of 150° C.$\leqq$T$\leqq$280° C. have proved to be particularly suitable.

The alloy and the magnetic field heat treatment should preferably be coordinated with one another. An essential coordination parameter in this case is the Curie temperature $T_c$ of the alloy. To be precise, it has emerged that the magnetic field treatments lead to signal strips with good harmonic signals only when the temperatures T selected there lie below the Curie temperature $T_c$ or do not substantially exceed the latter.

Alloys whose Curie temperatures $T_c$>200° C. and $T_c$>220° C. are particularly preferred.

These alloys respond particularly well in very short times to the heat treatments.

Alloys with a relatively low metalloid content generally have such Curie temperatures. Consequently, the ductility of the alloys can also be improved after the heat treatment. On the other hand, the lowering of the metalloid content in turn raises the saturation induction $B_s$, which entails a weakening of the harmonic signals for a prescribed geometry of the signal strips. Thus, it was possible to establish that for signal strips whose length was less than 10 cm there was an improvement of the harmonic signals when saturation induction $B_s$ was reduced. Saturation inductions of $B_s \leqq 0.7$ Tesla proved to be particularly suitable.

The preferred alloys were finally those whose composition is selected such that the saturation induction is $B_s \leqq 0.7$ Tesla while, at the same time, the Curie temperature is $T_c$>200° C. These contrary requirements can be achieved, inter alia, by providing a nickel content of at least 10 Atom % in alloys.

It follows from U.S. Pat. No. 4,552,136 and European Patent EP 0 121 649 B1 that in the case of an increased nickel content, the iron content of the alloy must be >10 Atoms % so that a harmonic signal cannot be impaired by mechanical stresses, for example by bending or twisting of the signal strip.

However, an alloy produced in accordance with the teaching of U.S. Pat. No. 4,552,136 and European Patent EP 0 121 649 B1 and having the composition of $Co_{43}Fe_{15}Ni_{20}Si_{13}B_9$ has proved to be entirely suitable, since the harmonic signal was no longer present even after a single twisting of a signal strip produced with a length of approximately 5 cm. A similar alloy for which the iron content was dropped nearly below 10 Atom %, specifically an alloy with the composition of $Co_{43.3}Fe_{6.7}Ni_{28}Si_{13}B_9$ has proved surprisingly, however, to be largely insensitive to twisting as regards its harmonic signal. Repeated twisting also had no negative influence on the harmonic signal.

The lower limits for heat treatment times and heat treatment temperatures follow from the above discussion from the requirement that the signal strip respond to the heat treatment, that is to say have a high proportion of harmonics in the case of the excitation described. The corresponding upper limits follow from the requirement that the signal strip must still be sufficiently ductile after the heat treatment.

Several typical experimental results are summarized in Table II and Table III, which serve to define suitable heat treatments. A distinction is made here between heat treatment on the tape coil and continuous heat treatment.

Table II: Examples for heat treatments in the transverse field on the tape coil. In the case of the brittle tape, no measurement of the harmonic response is possible, since because of the brittleness no tape strip could be cut off.

| Alloy | Heat treatment | Ductility | Harmonic response |
|---|---|---|---|
| $Co_{67.3}Fe_{3.7}Mo_{1.5}Si_{16.5}B_{11}$ | 20 h 70° C. | DUCTILE | Weak |
| | 10 h 190° C. | DUCTILE | GOOD |
| | 2 h 230° C. | DUCTILE, sporadic brittle sites | Weak |
| | 1 h 380° C. | BRITTLE | |
| $Co_{43.3}Fe_{6.7}Ni_{28}Si_{13}B_9$ | 1 h 100° C. | DUCTILE | Weak |
| | 10 h 190° C. | DUCTILE | GOOD |
| | 2 h 230° C. | DUCTILE | GOOD |
| | 1 h 380° C. | BRITTLE | |
| $Co_{74.5}Fe_{1.5}Mn_4Si_{11}B_9$ | 10 min 190° C. | DUCTILE | weak |
| | 10 h 190° C. | DUCTILE | GOOD |
| | 2 h 230° C. | DUCTILE | GOOD |
| | 1 h 380° C. | BRITTLE | |

Table III: Examples for continuous heat treatments with and without a tensile force of approximately 20N. If not otherwise indicated, the heat treatments were carried out in a magnetic field orientated transverse to the tape direction.

In the case of the brittle tape, no measurement of the harmonic response is possible, since because of the brittleness no tape strip could be cut off.

| Alloy | Heat treatment | Ductility | Harmonic response |
|---|---|---|---|
| $Co_{67.3}Fe_{3.7}Mo_{1.5}Si_{16.5}B_{11}$ | 10 s 230° C. without tension | DUCTILE | poor |
| | 10 s 230° C. with tension | DUCTILE | poor |
| | 10 s 350° C. without tension | DUCTILE | poor |
| | 10 s 350° C. with tension | DUCTILE | GOOD |
| | 10 s 350° C. with tension without magnetic field | DUCTILE | GOOD |
| | 60 s 420° C. | BRITTLE | |
| $Co_{43.3}Fe_{6.7}Ni_{28}Si_{13}B_9$ | 10 s 230° C. without tension | DUCTILE | poor |
| | 10 s 230° C. with tension | DUCTILE | poor |
| | 10 s 350° C. without tension | DUCTILE | moderate |
| | 10 s 350° C. with tension | DUCTILE | GOOD |
| | 10 s 350° C. with tension without magnetic field | DUCTILE | GOOD |
| | 60 s 420° C. | BRITTLE | |
| $Co_{74.5}Fe_{1.5}Mn_4Si_{11}B_9$ | 10 s 230° C. without tension | DUCTILE | poor |
| | 10 s 230° C. with tension | DUCTILE | poor |
| | 10 s 350° C. without tension | DUCTILE | GOOD |
| | 10 s 350° C. with tension | DUCTILE | GOOD |
| | 10 s 350° C. with tension without magnetic field | DUCTILE | GOOD |
| | 60 s 420° C. | BRITTLE | |

DETAILED DESCRIPTION OF THE INVENTION

Figure 1:
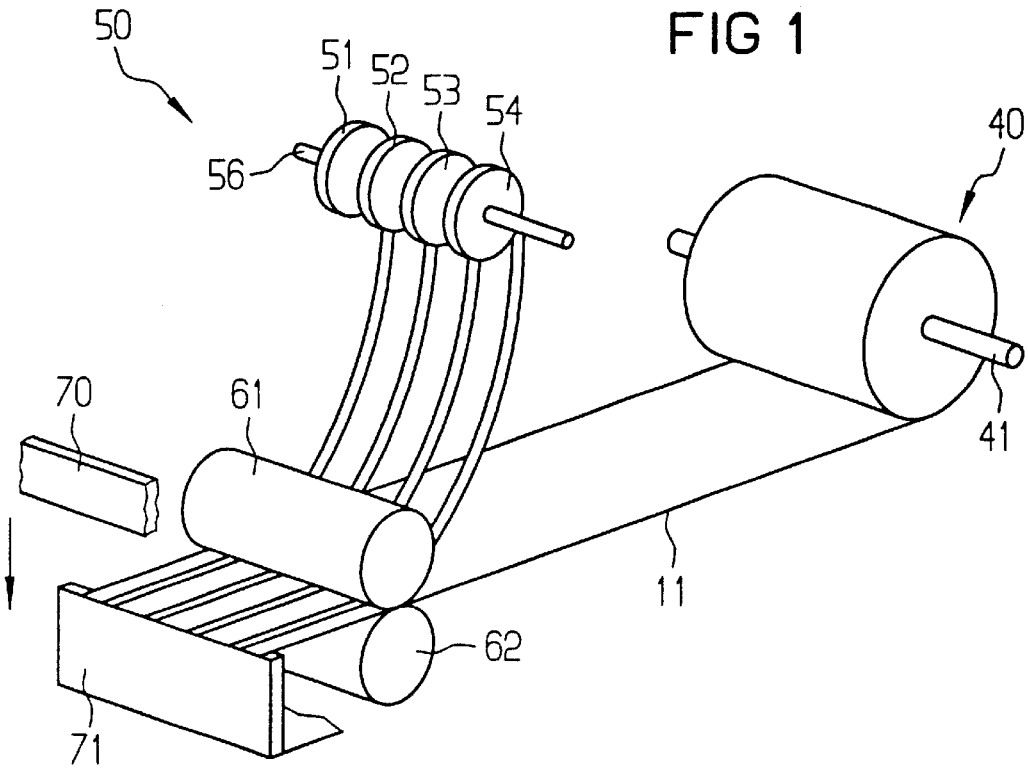
PRIOR ART FIG 1
FIG. 1 is a perspective view of tape material on a roller and the payout for producing magnetic marker strips and the application of several strips of ferromagnetic activation material on the material tape; the figure is copied from the above-mentioned German patent application DE 30 26 482.

Referring first to the prior art FIG. 1, tape material 11 is paid out from a roll 40 which is supported on a roller axle 41. Strips of ferromagnetic activation material are paid out from a payout assembly 50, which includes tour rolls 51, 52, 53, and 54 of strip material. The strips are pressed onto the tape 11 between two nipping pressure rollers 61 and 62. The tape with the strips is then cut transversely to the feed direction, i.e. the longitudinal axis of the tape 11, at a chopper 71, 70 which acts similarly to a guillotine.

Figure 2:
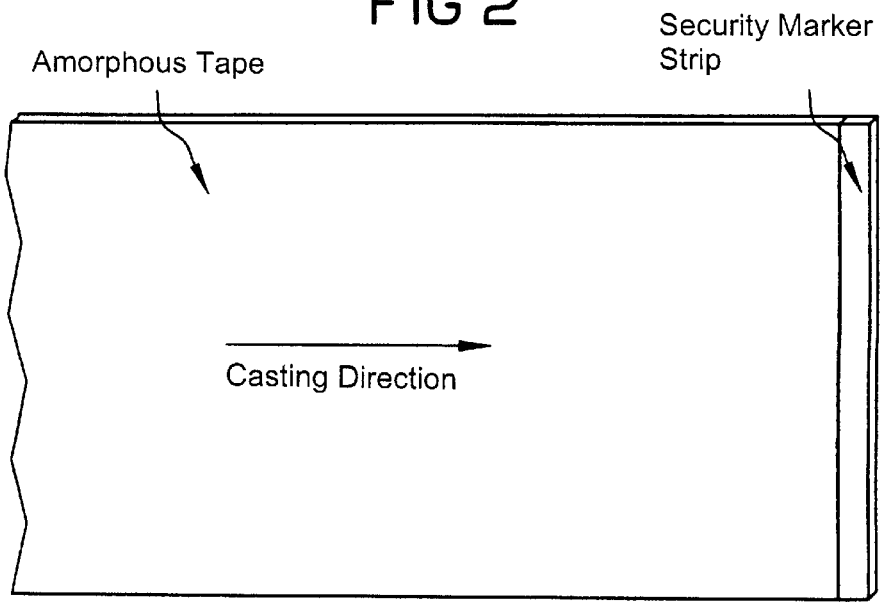
FIG. 2 is a plan view illustrating the amorphous tape material and a signal strip.

The following example will be understood with reference to FIG. 2. There, the amorphous tape is cast along a defined casting direction (the longitudinal axis of the tape) and the security marker strip is cut transversely to the casting direction and the longitudinal axis. The cast tape is heat treated so that a flat B-H loop is present along the casting direction. A tape of an amorphous, ferromagnetic alloy with a composition of $Co_{58}Fe_{5.5}Ni_{13}Si_{14.5}B_9$ was cast by means of rapid solidification with a tape width of 54 mm and a mean thickness 25 $\mu$m. The saturation magnetostriction was $\lambda_s$=−0.5 ppm, the saturation induction $B_s$ was 0.7 Tesla, thus providing an alloy which was identical to the alloys in the first two experiments named at the beginning. In accordance with the present invention, the cast tape was subjected to heat treatment. The heat treatment time in this case was two hours at a temperature of T=230° C., and therefore exactly as in the second experiment mentioned at the beginning. During the heat treatment, a constant magnetic field was applied again, but this time it was orientated parallel to the winding axis of the tape coil, that is to say transverse to the casting direction of the tape. The strength of the magnetic field was selected again such that the tape was ferromagnetically saturated in the direction of the applied magnetic field, for which this time a higher field strength of 2000 A/cm was required owing to the demagnetization factor parallel to the winding axis of the tape coil.

The tape was completely ductile after the heat treatment, that is to say it could be further processed mechanically without difficulty, such as, for instance, cutting, punching or similar methods, without breaking.

Figure 4:
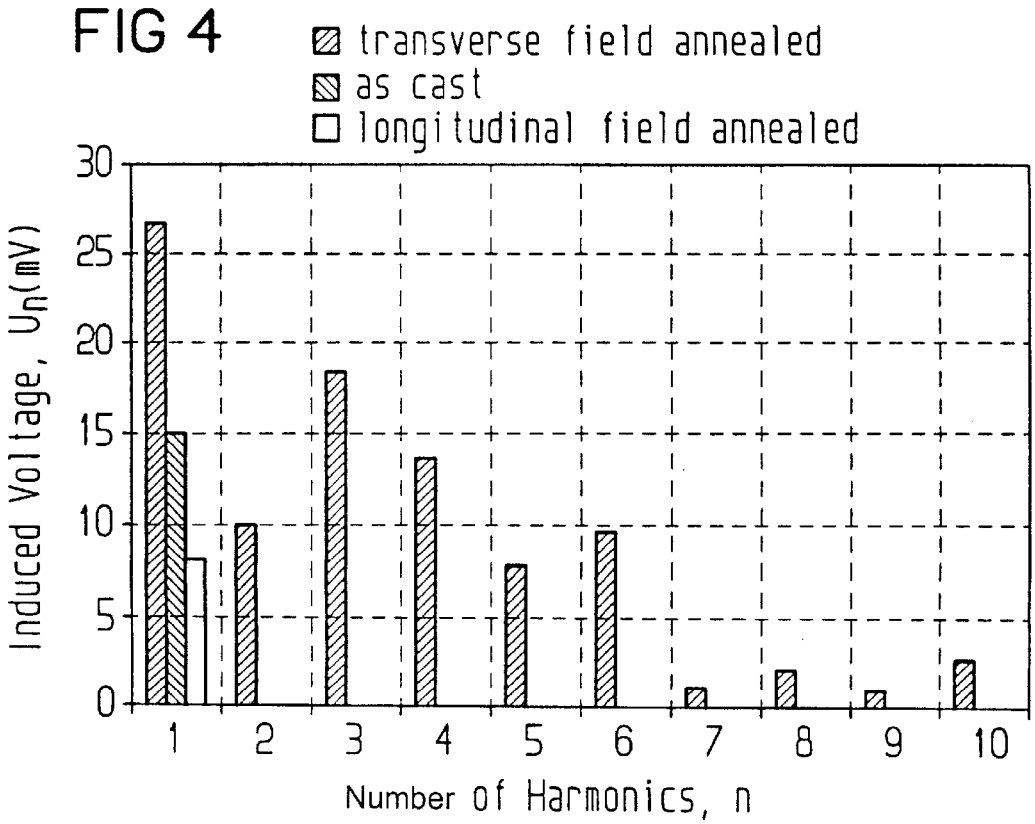
FIG. 4 is a chart showing the induced voltage strengths in ten harmonics.

After the heat treatment, the alloy this time had a flat B-H loop (measured again in the casting direction) with a rectangularity of <10%. A signal strip was severed again from the tape heat treated in this way in a fashion transverse to the tape direction with a width of 2 mm, and its harmonic signal was measured as described at the beginning. FIG. 4 shows the harmonic spectrum of the signal strip by comparison with the signal strip in the first experiment and in the second experiment. It is blatantly obvious that by contrast with the signal strip treated in the first and second experiments, this time there is a significantly higher proportion of harmonics such as is required in harmonic goods security systems for the purpose of detecting the signal strip.

Figure 3:
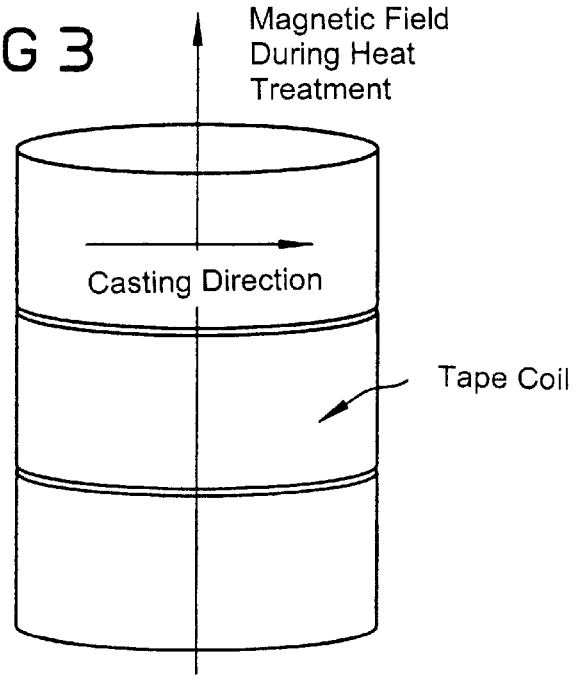
FIG. 3 is a perspective view of a tape coil illustrating an alternative embodiment of the invention.

FIG. 3 illustrates an alternative implementation. There, the tape is first wound into a coil about an axis that is transverse to the casting direction. The tape coil is then subjected to heat treatment and a magnetic field parallel to the winding axis of the coil.

FIG. 4 illustrates the harmonics spectrum of the signal strip produced in the first experiment and the second experiment. It is seen that the signal level intensity of the harmonics is indeed sufficient for use in a security system.

Figure 5:
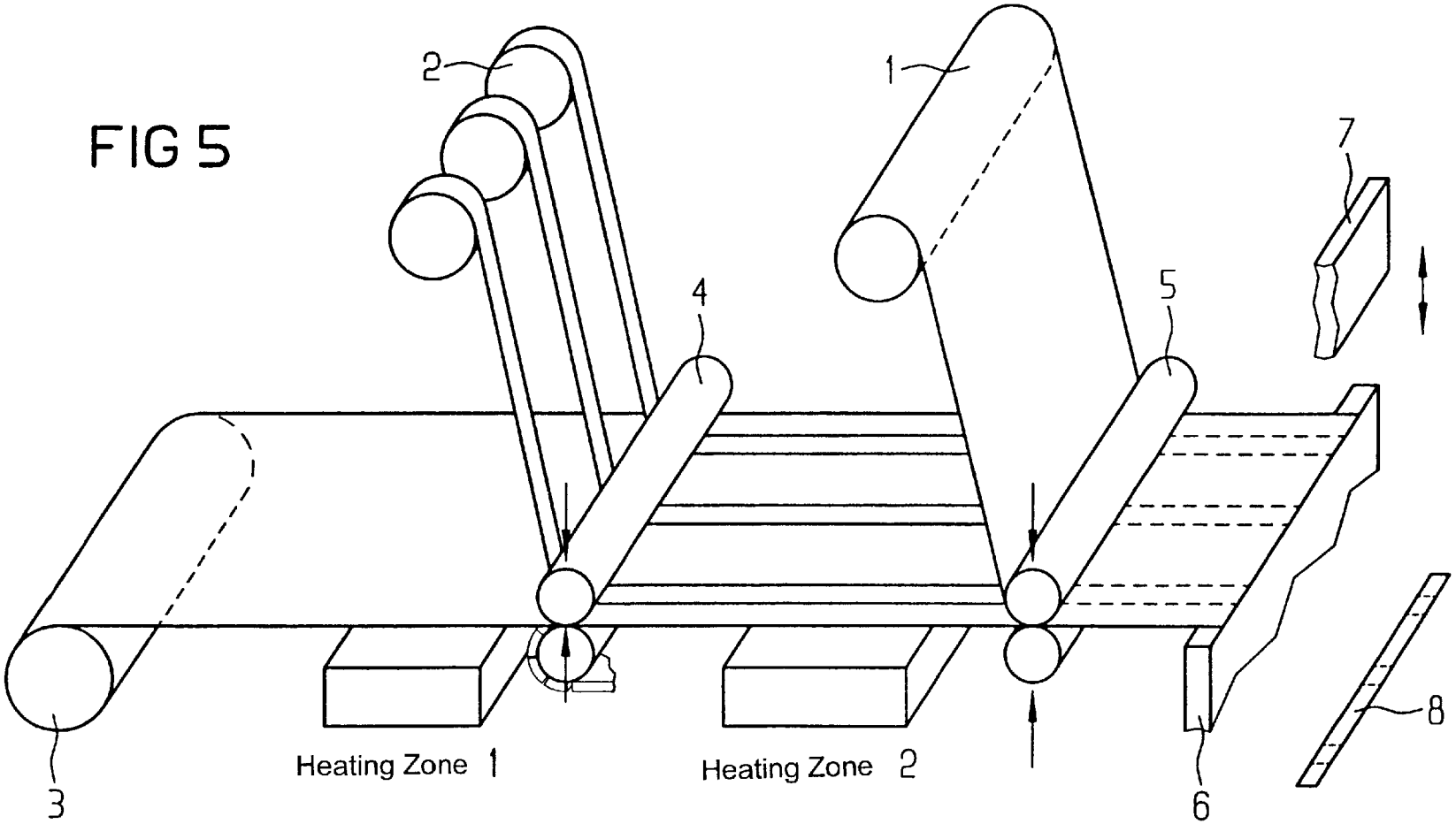
FIG. 5 is a perspective view similar to FIG. 1 showing continuous heat treatment and continuous formation of the signal strip.

A preferred exemplary embodiment for producing the display elements according to the invention follows from FIG. 5. Shown there is a production apparatus which is suitable for producing individual magnetic marker elements which are subsequently fastened in a separate process on or in the packaging of the goods.

According to this exemplary embodiment, for the purpose of production the deactivating elements are fastened on a backing film which is connected to the deactivating elements upon heating. The backing film is guided from a pay-out roller 3 over the heating zone 1 and heated there to a temperature of approximately 150° C. The backing film is connected between the pressure rollers 4 to three strips of the deactivation material which is paid out from three payout rollers 2.

Each element for deactivation consists of a magnetic semirigid alloy.

The tape thickness employed with these deactivating elements is 51 $\mu$m, and the tape width is respectively 8 mm. 4 mm is set in each case as the spacing between the deactivating elements respectively applied to the backing film. This assembly is then heated up again in the heating zone 2 to the temperature of 150° C. in order then to be connected between the pressure rollers 5 to a signal strip which is optimally heat-treated for use in this application. The tape used here consists of an alloy having the composition of $Co_{43.3}Fe_{6.7}Ni_{28}Si_{13}B_9$. After casting, the tape was wound on to form a tape coil and subjected to heat treatment in a magnetic field parallel to the winding axis of the tape coil. This stationary heat treatment was carried out for a heat treatment time t=2 h at a temperature of 230° C. The tape had dimensions of 40 mm×0.025 mm.

1.0 mm wide signal strips are respectively cut to length from the tape in the length-cutting unit 6, 7. The magnetic marker elements produced in this way can be checked with reference to their capacity for use in harmonic goods security systems:

The magnetic marker element was firstly excited in the finally magnetized state of the deactivating elements with the aid of an alternating magnetic field with an amplitude of 1 A/cm and a frequency of 1 kHz. The display element was orientated in this case parallel to the terrestrial magnetic field, which corresponds to a constant field magnetization of approximately 0.2 A/cm.

The change in induction caused by the alternating field was detected in an air-compensated pickup coil surrounding the centre of the display element and having 100 turns with the aid of the voltage induced there. The induced voltage was decomposed in this case into its constituent frequencies by means of a spectral analyzer, that is to say a harmonic analysis was carried out. A very high proportion of harmonics such as are used in harmonic goods security systems for detecting the magnetic marker element were obtained for the signal strips cut to length transversely.

In a further experiment, the deactivating elements were now remagnetized by applying a magnetic field of 250 A/cm, and the display element was thereafter subjected to the same magnetic harmonic analysis. The remagnetized deactivating elements now established only a portion of harmonics which was scarcely set off against the natural background noise. The magnetic marker elements were thereby rendered unrecognizable for a harmonic goods security system by the remagnetization of the deactivating elements. The magnetic marker element produced according to this exemplary embodiment therefore splendidly fulfills the requirements placed on a deactivatable magnetic marker element preferably used in the source tagging of goods.

In a development of the production method described above, as described in FIG. 6 the magnetic marker element is fastened directly on the packaging material. The integration described here of the production of the magnetic marker elements into the packaging machine leads to a very economic marking of the goods such as is required for source tagging, in particular.

Figure 6:
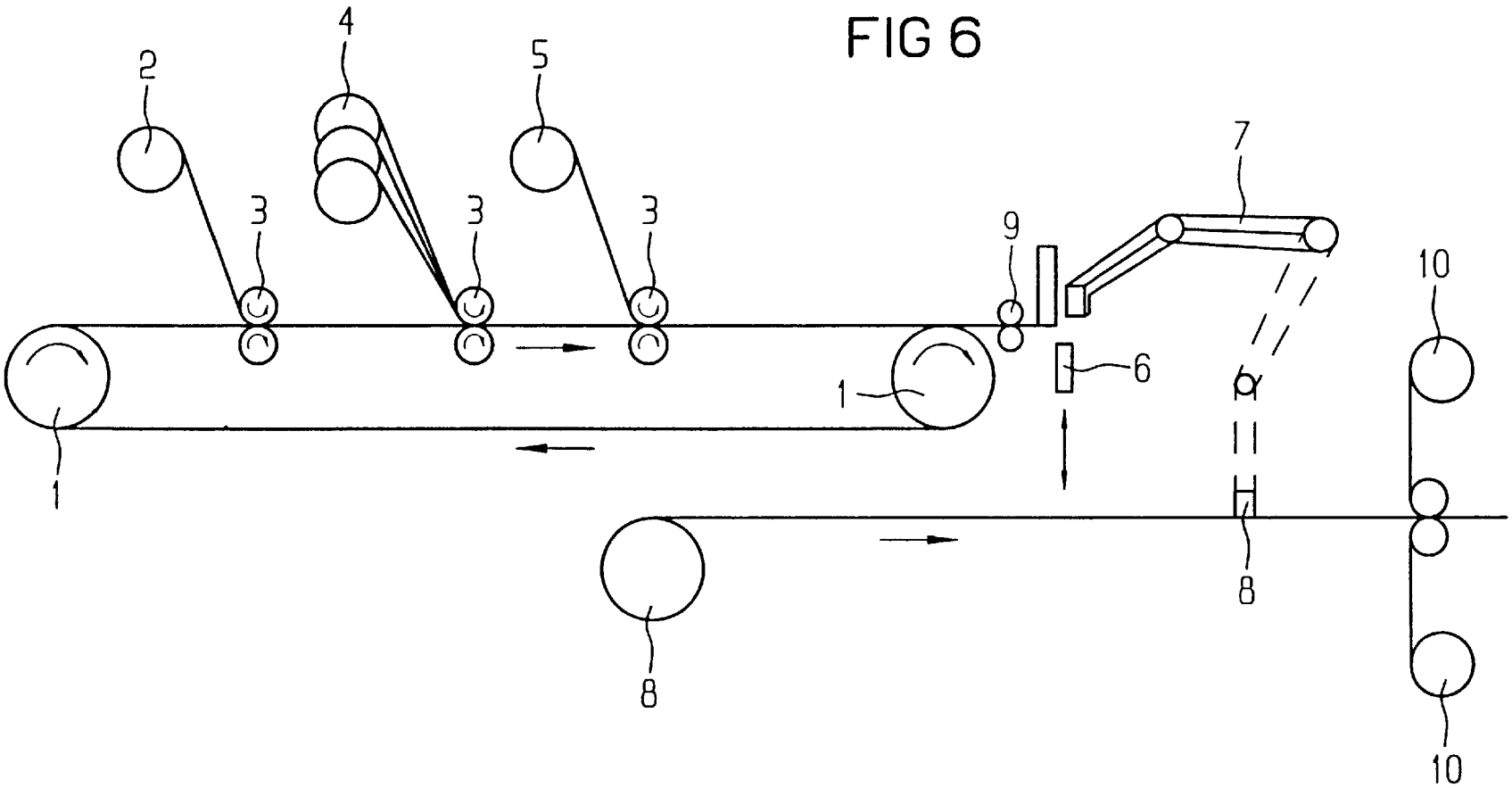
FIG. 6 is a diagrammatic side view of a system according to the invention.

According to FIG. 6, in the first step a backing film which is adhesive on both sides is fastened, with the aid of the pressure rollers 3, from a pay-out winch 2 onto an endless conveyor belt running over the transport rollers 1.

As in the previous example, which was described in FIG. 5, in the second process stage three deactivating elements are bonded from the pay-out rollers 4 on the adhesive film via the pressure rollers 3. In a further step, the tape is fastened from the pay-out roller 5 on the adhesive tape by the pressure rollers 3. The transport rollers 9, which are preferably TEFLON®-coated (PTFE), remove the adhesive tape from the endless conveyor belt and inserted into a device 6 for cutting to length.

Before the device 6 for cutting to length severs the magnetic marker element from the components fed, the magnetic marker element is fixed by a gripping arm by virtue of the fact that, for example, a permanent magnet is fastened in the functional surface of the gripping arm. This permanent magnet then attracts the magnetic marker element. Since the magnetic marker element has now been completely severed, it is pressed on the packaging material passing by the gripping arm.

The adhesive power of the backing film is now distinctly stronger than the magnetic fixing of the magnetic marker element on the gripping arm, with the result that the magnetic marker element is fixed on the packaging material.

After application of the magnetic marker element, the packaging material is coated with a laminate 10 on both sides and processed to form goods packaging in further subsequent steps, which are not shown here.

One magnetic marker element per package is now laminated into the package, and is therefore no longer visible to the customer. As is described further above, the appropriate packagings were then likewise tested in a harmonic goods security system and checked as deactivatable magnetic marker elements.

We claim:

1. A magnetic marker strip for generating a signal inside an interrogation zone in which a periodically varying magnetic field with a predetermined fundamental frequency is present, the magnetic marker strip comprising:

a signal strip of a first ferromagnetic material having a low coercive field strength, said signal strip having a greater length than width, and emitting harmonic-containing signals in a first, unmagnetized state when exposed to a magnetic field in an interrogation zone and emitting substantially no harmonic-containing signal in a second state in the magnetic field;

said signal strip being cut to length from a tape transversely to a longitudinal axis of the tape, said tape consisting of an amorphous, ductile alloy virtually free from magnetostriction, and having a flat B-H loop with an axis parallel to the longitudinal axis of the tape;

a second ferromagnetic material applied on said signal strip and having a coercive field strength distinctly higher than the coercive field strength of said first ferromagnetic material of said signal strip; and said second ferromagnetic material being formed in a plurality of deactivating elements disposed at a spacing from one another on said signal strip, said deactivating elements having a width substantially equal to the width of said signal strip, and said deactivating elements switching said signal strip into the first state when said deactivating elements are in a first, unmagnetized state, and switching said signal strip into the second state when said deactivating elements are in a second, magnetized state.

2. The marker strip according to claim 1, wherein said alloy has a composition consisting essentially of:

$$Co_aFe_bNi_cX_dB_eSi_f$$

where X is at least one element selected from the group of elements consisting of Cr, Mo, Nb, and Ta, and a, b, c, d, e, and f, in at %, satisfy the following conditions:

| | |
|---|---|
| $25 \leqq a \leqq 80$ | $0 \leqq d \leqq 5$ |
| $2 \leqq b \leqq 10$ | $8 \leqq e \leqq 20$ |
| $0 \leqq c \leqq 45$ | $0 \leqq f \leqq 18$ |

wherein $15 \leqq (e+f) \leqq 30$ and $a+b+c+d+e+f = 100$ and;

if appropriate, up to 2 at % of an existing B and Si content are replaced together by at least one element selected from the group of elements consisting of C, P, Al, and Ge;

if appropriate, up to 5 at % of an existing Fe content is replaced by Mn.

3. The marker strip according to claim 2, wherein $19 \leqq (e+f) \leqq 23$ and $20 \leqq c \leqq 45$.

4. The marker strip according to claim 2, wherein $23 \leqq (e+f) \leqq 26$ and $10 \leqq c \leqq 20$.

5. The marker strip according to claim 2, wherein $26 \leqq (e+f) \leqq 30$ and $c \leqq 10$.

6. The marker strip according to claim 1, wherein said signal strip has a saturation magnetization of $B_s \leqq 0.7$ T.

7. The marker strip according to claim 1, wherein said alloy has a saturation magnetostriction of $|\lambda_s| \leqq 1$ ppm.

8. The marker strip according to claim 1, wherein the signal generated by the marker strip is adapted to be picked up by a scanning device and, if a higher-order harmonic of the fundamental frequency is detected in the signal, for a display to be generated.

9. A method of producing the marker strip according to claim 1, which comprises the following steps:

casting an amorphous, ferromagnetic tape with a longitudinal axis from a melt by rapid solidification;

subjecting the amorphous, ferromagnetic tape to continuous heat treatment;

applying at least two comparatively narrow strips of a ferromagnetic material with a distinctly higher coercive field strength to the amorphous, ferromagnetic tape axially parallel to the longitudinal axis;

connecting the strips to the tape; and cutting the amorphous, ferromagnetic tape and the strips to length transverse to the longitudinal axis of the amorphous, ferromagnetic tape.

10. The method according to claim 9, wherein the amorphous, ferromagnetic tape is subjected to continuous heat treatment under tensile strength.

11. The method according to claim 9, which comprises subjecting the amorphous, ferromagnetic tape to heat treatment in a magnetic field transverse to the longitudinal axis of the amorphous, ferromagnetic tape.

12. The method according to claim 9, wherein the connecting step comprises gluing the strips to the tape.

13. A method of producing the marker strip according to claim 1, which comprises the following steps:

casting an amorphous, ferromagnetic tape from a melt by rapid solidification;

winding the amorphous, ferromagnetic tape about a winding axis to form a tape coil;

subjecting the tape coil to heat treatment in a magnetic field parallel to the winding axis of the tape coil;

subsequently, applying from the heat-treated tape coil at least two relatively narrow strips of a ferromagnetic material with a distinctly higher coercive field strength to the amorphous, ferromagnetic tape axially parallel to the longitudinal axis of the tape;

connecting the strips to the tape; and cutting to length the amorphous, ferromagnetic tape and the strips connected thereto transverse to the longitudinal axis of the amorphous, ferromagnetic tape.

14. The method according to claim 9, wherein the connecting step comprises gluing the strips to the tape.

* * * * *